US005318642A

United States Patent [19]

Kita

[11] Patent Number: 5,318,642

[45] Date of Patent: Jun. 7, 1994

[54] HIGH-STRENGTH ROLLED SHEET OF ALUMINUM ALLOY AND PROCESS FOR PRODUCING THE SAME

[75] Inventor: Kazuhiko Kita, Uozu, Japan

[73] Assignee: Yoshida Kogyo K.K., Tokyo, Japan

[21] Appl. No.: 8,760

[22] Filed: Jan. 25, 1993

[30] Foreign Application Priority Data

Feb. 28, 1992 [JP] Japan ..... 4-43011

[51] Int. Cl.[5] ..... C22F 1/04

[52] U.S. Cl. ..... 148/551; 148/552; 148/437; 148/438; 148/439; 148/440

[58] Field of Search ..... 148/551, 437, 438, 439, 148/440, 552; 420/528, 551, 538, 540, 547, 548

[56] References Cited

U.S. PATENT DOCUMENTS 5,053,085 10/1991 Masumoto et al. ..... 148/439

FOREIGN PATENT DOCUMENTS 460887 12/1991 European Pat. Off. .
534470 3/1993 European Pat. Off. .
55-161043 12/1980 Japan .
63-062836 3/1988 Japan .

OTHER PUBLICATIONS

Chemical Abstracts, vol. 117, No. 10, Sep. 7, 1992, Columbus, Ohio; abstract No. 9549r, *abstract* and JP-A-432541 (Kobe Steel) Feb. 4, 1992.

*Primary Examiner*—Richard O. Dean
*Assistant Examiner*—Robert R. Koehler
*Attorney, Agent, or Firm*—Flynn, Thiel, Boutell & Tanis

[57] ABSTRACT

A high-strength rolled sheet of an aluminum alloy having a composition represented by the general formula $Al_{bal}Ni_aX_b$, $Al_{bal}Ni_aX_bM_c$ or $Al_{bal}Ni_aX_bM_cQ_d$, wherein X represents at least one element selected from among La, Ce, Mm, Ti and Zr; M represents at least one element selected from among V, Cr, Mn, Fe, Co, Y, Nb, Mo, Hf, Ta and W; Q represents at least one element selected from among Mg, Si, Cu and Zn; and a, b, c and d are, in atomic percentages, $2 \leqq a \leqq 10$, $0.1 \leqq b \leqq 3 \leqq 0.1 \leqq c \leqq 2$ and $0.01 \leqq d \leqq 2$, wherein intermetallic compounds crystallized therefrom have a maximum particle size of 10 μm or less. The rolled sheet can be easily produced by subjecting a melt of an alloy having the above-described composition to rolling simultaneously with cooling and solidification to provide a rolled sheet and has high strength and rigidity and excellent heat resistance and ductility.

9 Claims, 1 Drawing Sheet

HIGH-STRENGTH ROLLED SHEET OF ALUMINUM ALLOY AND PROCESS FOR PRODUCING THE SAME

BACKGROUND OF THE INVENTION

1. Field of the Invention

The present invention relates to a rolled sheet of an aluminum alloy having a high strength, a high rigidity and an excellent heat resistance, and to a process for producing the same.

2. Description of the Prior Art

Conventional high-strength, heat-resistant, rolled sheets of an aluminum alloy and process for producing the same are described in the specification of Japanese Patent Laid-Open No. 62836/1988. The rolled aluminum sheet disclosed in the above specification has a composition comprising 0.10 to 5.0% by weight of Mg and 0.3 to 3.0% by weight of Mn or a composition comprising 0.10 to 5.0% by weight of Mg, 0.3 to 3.0% by weight of Mn and 0.01 to 0.30% of Zr, wherein intermetallic compounds crystallized on the surface thereof have a maximum particle size of 10 μm or less. Further, the above specification discloses a process for producing the rolled sheet, wherein a melt of the above-described alloy is subjected to continuous cast rolling.

In the above-described conventional rolled sheet, there is room for improvement in the strength, rigidity and heat resistance, and the development of a rolled sheet having superior properties in respect of strength, rigidity and heat resistance has been desired in the art.

SUMMARY OF THE INVENTION

Accordingly, in view of the above-described circumstances, an object of the present invention is to provide a high-strength rolled sheet of an aluminum alloy which is superior to the conventional rolled sheets in strength, rigidity, heat resistance and ductility and a process for producing the same.

The first aspect of the present invention is directed to a high-strength rolled sheet of an aluminum alloy consisting of a composition represented by the general formula $Al_{bal}Ni_aX_b$, wherein X represents at least one element selected from among La, Ce, Mm, Ti and Zr; and a and b are, in atomic percentages, $2 \leqq a \leqq 10$ and $0.1 \leqq b \leqq 3$, wherein intermetallic compounds crystallized therefrom have a maximum particle size of 10 μm or less.

The second aspect of the present invention is directed to a high-strength rolled sheet of an aluminum alloy consisting of a composition represented by the general formula $Al_{bal}Ni_aX_bM_c$, wherein X represents at least one element selected from among La, Ce, Mm, Ti and Zr; M represents at least one element selected from among V, Cr, Mn, Fe, Co, Y, Nb, Mo, Hf, Ta and W; and a, b and c are, in atomic percentages, $2 \leqq a \leqq 10$, $0.1 \leqq b \leqq 3$ and $0.1 \leqq c \leqq 2$, wherein intermetallic compounds crystallized therefrom have a maximum particle size of 10 μm or less.

The third aspect of the present invention is directed to a high-strength rolled sheet of an aluminum alloy consisting of a composition represented by the general formula $Al_{bal}Ni_aX_bM_cQ_d$, wherein X represents at least one element selected from among La, Ce, Mm, Ti and Zr; M represents at least one element selected from among V, Cr, Mn, Fe, Co, Y, Nb, Mo, Hf, Ta and W; Q represents at least one element selected from among Mg, Si, Cu and Zn; and a, b, c and d are, in atomic percentages, $2 \leqq a \leqq 10$, $0.1 \leqq b \leqq 3$, $0.1 \leqq c \leqq 2$ and $0.01 \leqq d \leqq 2$, wherein intermetallic compounds crystallized therefrom have a maximum particle size of 10 μm or less.

In the high-strength rolled sheets of aluminum alloys according to the above three aspects, the crystallized intermetallic compounds comprise $Al_3Ni$ and the maximum particle size of $Al_3Ni$ is 10 μm or less.

The present invention also relates to a process for producing the above-described high-strength aluminum alloy rolled sheets, the process comprising subjecting a melt of an alloy consisting of a composition represented by any one of the above-described general formulae to continuous cast rolling wherein the melt is rolled simultaneously with cooling solidification. It is preferred that the cooling rate in the cooling solidification be 50° C./sec or more and the thickness of the produced rolled sheet be regulated to 1 to 10 mm.

BRIEF DESCRIPTION OF THE DRAWING

The single FIGURE is an explanatory view of continuous cast rolling apparatus suitable for use in the process of the present invention.

DETAILED DESCRIPTION OF THE PREFERRED EMBODIMENTS

Figure 1:
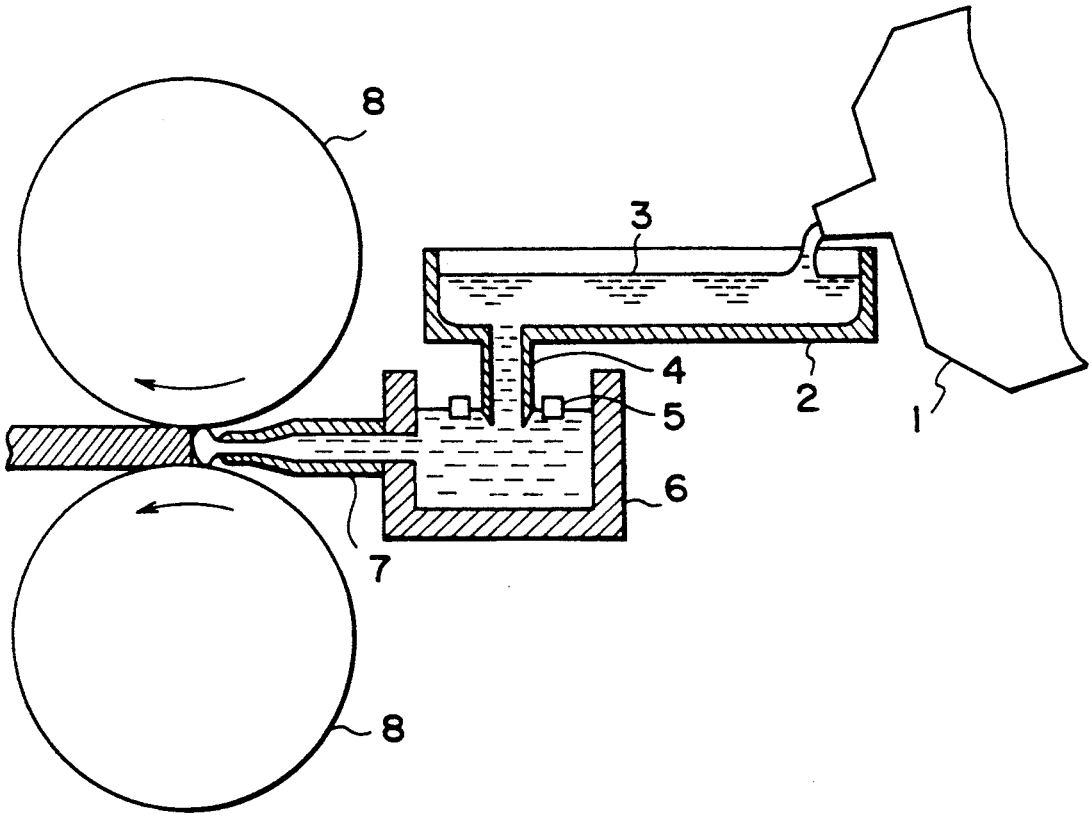

The compositions according to the present invention represented by the above-described general formulae will now be described.

The Ni element is in the form of a crystalline structure of $Al_3Ni$ dispersed with a particle size of about 10 μm or less and contributes to an improvement in the strength, rigidity and hardness of the sheet material. When the Ni content is less than 2 atomic %, the strength and rigidity are unsatisfactory. On the other hand, when it exceeds 10 atomic %, the structure coarsens during casting, so that the strength lowers.

The X element is at least one element selected from among La, Ce, Mm, Ti and Zr, has an effect of refining the matrix and, at the same time, is dispersed in the form of intermetallic compounds formed of the X element and Al, which contribute to an improvement in the thermal stability of the structure. When the X content is less than 0.1 atomic %, the effect of refining the matrix is unsatisfactory. On the other hand, when it exceeds 3 atomic %, the ductility during rolling is unsatisfactory, so that it becomes difficult to prepare a good sheet material.

The M element is at least one element selected from among V, Cr, Mn, Fe, Co, Y, Nb, Mo, Hf, Ta and W. These elements have an effect of refining the matrix and, at the same time, is dispersed in the form of intermetallic compounds formed of the M element and Al, which contribute to an improvement in the thermal stability of the structure. When the M content is less than 0.1 atomic %, the effect of refining the matrix is unsatisfactory. On the other hand, when it exceeds 2 atomic %, the ductility becomes insufficient.

The Q element is at least one element selected from among Mg, Si, Cu and Zn. It combines with Al or another Q element to form compounds which serve to increase the strength of the matrix. When the Q content is less than 0.01 atomic %, the effect of strengthening the matrix is unsatisfactory, while when it exceeds 2 atomic %, the ductility becomes unsatisfactory.

When the maximum particle size of the crystallized intermetallic compounds is 10 μm or less, it becomes possible to improve the strength, rigidity and hardness of the rolled sheet and, at the same time, to prepare a rolled sheet having sufficient heat resistance and ductility.

The process of the present invention will now be described in more detail. A sheet having a thickness of 1 to 10 mm is cast by the continuous cast rolling process wherein a molten alloy having the above-described composition is poured through a nozzle into between molds comprising a pair of cooling rolls for casting, the rolls being rotated and cooled from the inside thereof, or a pair of traveling casting belts; and rolled between the molds simultaneously with cooling solidification. Then, the rolled sheet is cold-rolled to a final sheet thickness. In this case, the casting rate is preferably in the range of from 500 to 1,500 mm/min, and the temperature of the molten alloy during casting is preferably in the range of from 680° to 880° C. The cooling rate is 50° C./sec or more, and the effect of rolling derived from the twin-roll casting, etc. are added, so that the amount of coarse $Al_3Ni$ having a particle size of 5 μm or more in the resultant structure is very small.

In the casting of a rolled sheet of an aluminum sheet having the above-described composition, a sheet having a thickness of 1 to 10 mm is produced by continuous cast rolling. Specifically, for example, it is possible to apply a method wherein a molten alloy having the above-described composition is poured through a nozzle into between molds comprising a pair of cooling rolls for casting, said rolls being rotated and cooled from the inside thereof, or a pair of travelling casting belts and rolling is conducted simultaneously with cooling and solidification between the molds. In the continuous cast rolling, it is preferred that the casting rate be 500 to 1,500 mm/min and the molten alloy temperature during casting be in the range of from 680° to 880° C.

In the above-mentioned continuous cast rolling into a sheet having a thickness of 1 to 10 mm, the cooling rate is 50° to 1,100° C./sec which is much higher than that in the case of semi-continuous casting. Therefore, the size of the crystal becomes remarkably fine by virtue of the quench solidification effect, which is advantageous in the improvement in the strength. On the other hand, in the semi-continuous casting, the intermetallic compound of $Al_3Ni$ is crystallized in the coarse grain form, so that the strength becomes poor. The present inventors have conducted an examination on the relationship between the maximum particle size of the crystal and the strength. As a result, it was found that a good strength property can be attained when the maximum size of the crystal is 10 μm or less.

In the continuous cast rolling, when the cast sheet thickness is less than 1 mm, the casting per se becomes difficult. On the other hand, when the cast sheet thickness exceeds 10 mm, the cooling rate becomes so low that the size of the crystal becomes large, which makes it impossible to obtain an intended strength. Therefore, the cast sheet thickness in the continuous cast rolling was limited to 1 to 10 mm.

If necessary, the cast mass in the sheet form having a thickness of 1 to 10 mm produced by the above-described continuous cast rolling may be coldrolled to a final thickness. In the cold rolling, intermediate annealing can be conducted as a pretreatment or an intermediate treatment for the purpose of imparting homogeneity and heat resistance.

The production process will now be specifically described with reference to a continuous cast rolling apparatus shown in the FIGURE. In the FIGURE, numeral 1 designates a casting furnace where an alloy having the above-described composition is melted, and the molten alloy 3 is fed into a launder 2. The molten alloy 3 fed into the launder 2 is then fed into a basin 6, injected through a nozzle 7 formed in the basin 6 into between a pair of casting rolls 8 made of Fe or Cu and provided at the end of the nozzle 7, and cooled and solidified on the surface of the pair of rolls 8. At the same time, the pair of rolls 8 are rotated for rolling, thereby preparing the rolled sheet of an aluminum alloy according to the present invention. In the FIGURE, numeral 4 designates a molten alloy feed pipe and numeral 5 a float which can regulate the height of the molten alloy 3 in the basin 6.

The present invention will now be described in more detail with reference to the following Examples.

EXAMPLES

Molten alloys having a predetermined composition specified in Table 1 were prepared, and various test rolled sheets were prepared by the continuous cast rolling apparatus shown in the FIGURE. In this case, rolled sheets having a thickness in the range of from 1 to 10 mm were produced under the conditions of a molten alloy temperature of 680 to 880° C. and a casting rate of 500 to 1,500 mm/min.

For comparison, a semicontinuous casting/hot rolling process was carried out. For further comparison, rolled sheets each having a composition outside the scope of the present invention were prepared.

The prepared rolled sheets of the present invention and the comparative rolled sheets were subjected to the measurements of their yield strength and the maximum particle size of the substance crystallized on the surface of each rolled sheet, and the results are given in the right column of Table 1. From Table 1, it is apparent that the rolled sheets of the present invention are superior to the comparative rolled sheets. Further, it is apparent that when the alloy composition falls within the scope of the present invention and the maximum particle size of the crystallized intermetallic compounds ($Al_3Ni$ in the Examples) is 10 μm or less, the resultant rolled sheets had an excellent yield strength.

TABLE 1

| Ex. | Alloy composition (at. %) (Al: bal.) | Casting process | Size of crystal (μm) | Yield strength (kgf/mm$^2$) |
|---|---|---|---|---|
| Comp. Ex. 1 | Fe = 0.4, Si = 0.4, Mn = 4 | semicontinuous casting/rolling | 10 | 31 |
| Comp. Ex. 2 | Fe = 0.2, Si = 0.2, Mg = 0.2 | continuous casting/rolling | 9 | 25 |
| Comp. Ex. 3 | Ni = 1, Mg = 0.2 | continuous casting/rolling | 8 | 27 |
| Invention Ex. 1 | Ni = 3, La = 0.2 | continuous casting/rolling | 7 | 45 |
| Invention | Ni = 3, Ce = 2.5, | continuous | 6 | 46 |

TABLE 1-continued

| Ex. | Alloy composition (at. %) (Al: bal.) | Casting process | Size of crystal (μm) | Yield strength (kgf/mm$^2$) |
|---|---|---|---|---|
| Ex. 2 | V = 0.2 | casting/rolling | | |
| Invention | Ni = 4, Mm = 1, | continuous | 5 | 42 |
| Ex. 3 | Cr = 0.4 | casting/rolling | | |
| Invention | Ni = 4, Mm = 1.5, | continuous | 7 | 52 |
| Ex. 4 | Mn = 0.2 | casting/rolling | | |
| Invention | Ni = 5, Zr = 2.5, | continuous | 6 | 55 |
| Ex. 5 | Fe = 0.4 | casting/rolling | | |
| Invention | Ni = 6, Zr = 1.7, | continuous | 6 | 56 |
| Ex. 6 | Co = 0.2 | casting/rolling | | |
| Invention | Ni = 6, Ti = 0.5, | continuous | 6 | 69 |
| Ex. 7 | Y = 1 | casting/rolling | | |
| Invention | Ni = 7, Ti = 1.2, | continuous | 7 | 55 |
| Ex. 8 | Mg = 0.2, Zn = 0.2 | casting/rolling | | |
| Invention | Ni = 8, Mm = 0.5, | continuous | 6 | 67 |
| Ex. 9 | Zr = 0.2, Si = 0.2 | casting/rolling | | |
| Invention | Ni = 9, Mm = 0.5, | continuous | 7 | 65 |
| Ex. 10 | Ti = 0.2, Cu = 0.5 | casting/rolling | | |

As described above, according to the present invention, it is possible to provide an aluminum alloy rolled sheet having a high strength, a high rigidity, a high heat strength and an excellent ductility.

Further, according to the process of the present invention, the rolled sheet having the above-described excellent properties can be easily produced.

What is claimed:

1. A process for producing a high-strength rolled sheet of an aluminum alloy, the process comprising subjecting a melt of an alloy consisting of a composition represented by the general formula $Al_{bal}Ni_aX_b$, wherein X represents at least one element selected from among La, Ce, Mm, Ti and Zr; and a and b are, in atomic percentages, $2 \leqq a \leqq 10$ and $0.1 \leqq b \leqq 3$, to continuous cast rolling, wherein the alloy is rolled simultaneously with cooling solidification to provide a rolled sheet and intermetallic compounds crystallized therefrom have a maximum particle size of 10 μm or less.

2. A process for producing a high-strength rolled sheet of an aluminum alloy, the process comprising subjecting a melt of an alloy consisting of a composition represented by the general formula $Al_{bal}Ni_aX_bM_c$, wherein X represents at least one element selected from among La, Ce, Mm, Ti and Zr; M represents at least one element selected from among V, Cr, Mn, Fe, Co, Y, Nb, Mo, Hf, Ta and W; and a, b and c are, in atomic percentages, $2 \leqq a \leqq 10$, $0.1 \leqq b \leqq 3$ and $0.1 \leqq c \leqq 2$, to continuous cast rolling, wherein the alloy is rolled simultaneously with cooling solidification to provide a rolled sheet and intermetallic compounds crystallized therefrom have a maximum particle size of 10 μm or less.

3. A process for producing a high-strength rolled sheet of an aluminum alloy, the process comprising subjecting a melt of an alloy consisting of a composition represented by the general formula $Al_{bal}Ni_aX_bM_cQ_d$, wherein X represents at least one element selected from among La, Ce, Mm, Ti and Zr; M represents at least one element selected from among V, Cr, Mn, Fe, Co, Y, Nb, Mo, Hf, Ta and W; Q represents at least one element selected from Mg, Si, Cu and Zn; and a, b, c and d are, in atomic percentages, $2 \leqq a \leqq 10$, $0.1 \leqq b \leqq 3$, $0.1 \leqq c \leqq 2$ and $0.01 \leqq d \leqq 2$, to continuous cast rolling, wherein the alloy is rolled simultaneously with cooling solidification to provide a rolled sheet and intermetallic compounds crystallized therefrom have a maximum particle size of 10 μm or less.

4. A process for producing a high-strength rolled sheet of an aluminum alloy according to claim 1, wherein the intermetallic compounds comprise $Al_3Ni$.

5. A process for producing a high-strength rolled sheet of an aluminum alloy according to claim 2, wherein the intermetallic compounds comprise $Al_3Ni$.

6. A process for producing a high-strength rolled, sheet of an aluminum alloy according to claim 3, wherein the intermetallic compounds comprise $Al_3Ni$.

7. A process for producing a high-strength rolled sheet of an aluminum alloy according to claim 1, wherein the cooling solidification is conducted at a cooling rate of 50° C./sec or more and the thickness of the produced rolled sheet is 1 to 10 mm.

8. A process for producing a high-strength rolled sheet of an aluminum alloy according to claim 1, wherein the cooling solidification is conducted at a cooling rate of 50° C./sec or more and the thickness of the produced rolled sheet is 1 to 10 mm.

9. A process for producing a high-strength rolled sheet of an aluminum alloy according to claim 3, wherein the cooling solidification is conducted at a cooling rate of 50° C./sec or more and the thickness of the produced rolled sheet is 1 to 10 mm.

* * * * *

UNITED STATES PATENT AND TRADEMARK OFFICE

CERTIFICATE OF CORRECTION

PATENT NO. 5 318 642

DATED June 7, 1994

INVENTOR(S) Kazuhiko KITA

It is certified that error appears in the above-indentified patent and that said Letters Patent is hereby corrected as shown below:

Column 6, line 47; change "1" to ---2---.

Signed and Sealed this

First Day of November, 1994

Bruce Lehman

*Attest:*

BRUCE LEHMAN

*Attesting Officer*

*Commissioner of Patents and Trademarks*